United States Patent [19]

Rich, Jr.

[11] Patent Number: 4,795,037

[45] Date of Patent: Jan. 3, 1989

[54] PROCESS FOR SEPARATING HIGH ASH COAL FROM REFUSE

[76] Inventor: John W. Rich, Jr., Box 211, Auburn, Pa. 17922

[21] Appl. No.: 860,464

[22] Filed: May 7, 1986

[51] Int. Cl.[4] ..... B03B 5/34; B03B 7/00; C10L 5/00

[52] U.S. Cl. ..... 209/3; 44/621; 209/17; 209/39; 209/211

[58] Field of Search ..... 209/3, 12, 17, 39, 211; 44/605, 606, 608, 620, 621, 626, 627

[56] References Cited

U.S. PATENT DOCUMENTS

| | | | |
|---|---|---|---|
| 2,623,637 | 12/1952 | Fontein | 209/211 X |
| 2,696,299 | 12/1954 | Van Os | 209/211 X |
| 2,701,641 | 2/1955 | Krijgsman | 209/211 X |
| 2,724,503 | 11/1955 | Fontein | 209/211 |
| 2,817,441 | 12/1957 | Leeman et al. | 209/211 |
| 3,353,673 | 11/1967 | Visman | 209/211 |
| 3,379,308 | 4/1968 | Horiuchi | 209/211 X |
| 4,028,228 | 6/1977 | Ferris et al. | 209/39 |
| 4,140,628 | 2/1979 | Horsfall | 209/211 X |
| 4,364,822 | 12/1982 | Rich, Jr. | 209/211 X |
| 4,529,506 | 7/1985 | Smit | 209/211 X |

*Primary Examiner*—Robert B. Reeves
*Assistant Examiner*—Edward M. Wacyra
*Attorney, Agent, or Firm*—Howson and Howson

[57] ABSTRACT

A process particularly suited for producing anthracite coal having an ash content greater than about 20 percent. In the process, an aqueous feedstock slurry composed of raw input and a heavy medium having a magnetic component is subjected to a particular type of cyclonic separating action which produces a coal product having a specific gravity of at least about 1.9 while the specific gravity of the heavy medium is maintained at least about 0.4 units below the specific gravity of the coal product. The configuration of the cyclones and composition of heavy medium is such as to enable separation to occur at a relatively high specific gravity with a medium of relatively low specific gravity and viscosity, thereby minimizing magnetite ore losses and energy required to effect separation.

3 Claims, 1 Drawing Sheet

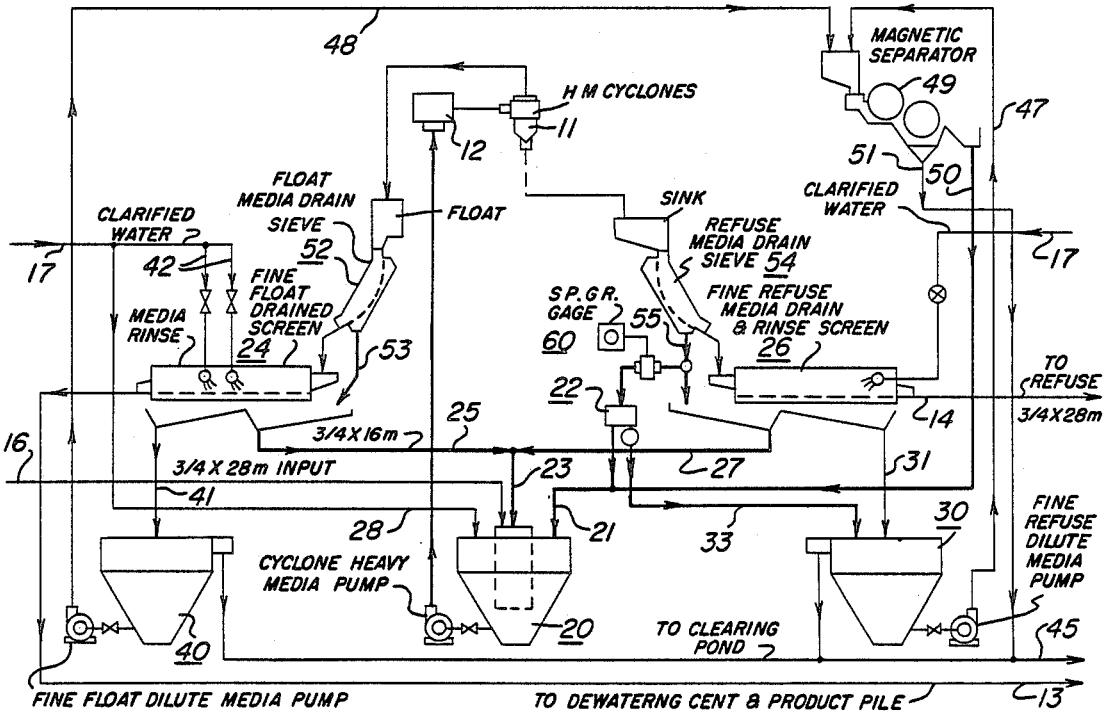

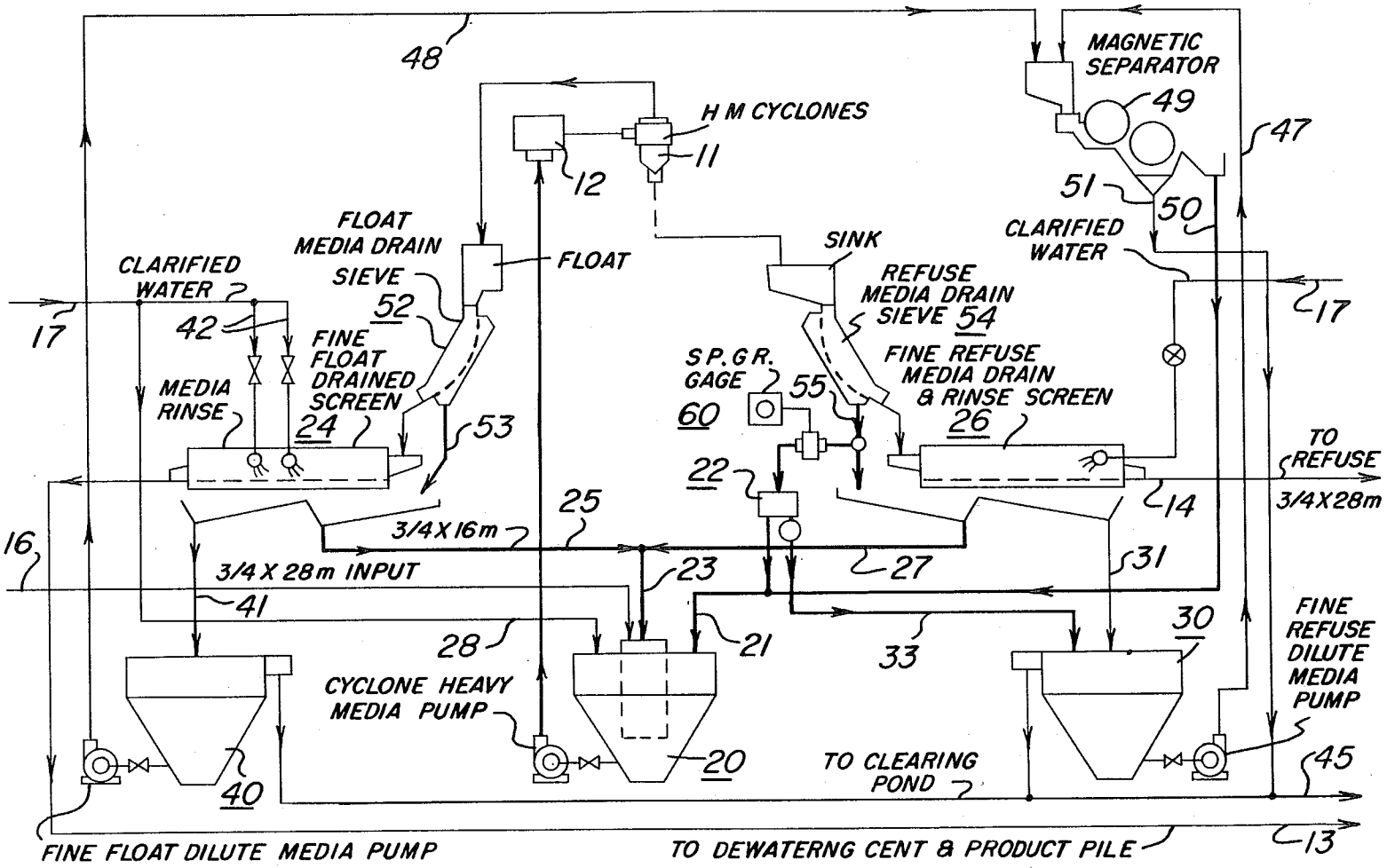
MAGNETIC SEPARATOR
CLARIFIED WATER
TO REFUSE 3/4X28m
FINE REFUSE DILUTE MEDIA PUMP
TO DEWATERNG CENT & PRODUCT PILE
REFUSE MEDIA DRAIN SIEVE
FINE REFUSE MEDIA DRAIN & RINSE SCREEN
SINK
TO CLEARING POND
H M CYCLONES
S.P.G.R. GAGE
FLOAT
FLOAT MEDIA DRAIN SIEVE
FINE FLOAT DRAINED SCREEN
3/4X16m
3/4X28m INPUT
CYCLONE HEAVY MEDIA PUMP
CLARIFIED WATER
MEDIA RINSE
FINE FLOAT DILUTE MEDIA PUMP

PROCESS FOR SEPARATING HIGH ASH COAL FROM REFUSE

FIELD OF THE INVENTION

The present invention relates to processes for separating coal from refuse, and more particularly, the present invention relates to a process for separating a relatively high ash coal product from refuse.

BACKGROUND OF THE INVENTION

For many years anthracite coal has been separated from mine tailings by forming a feedstock slurry composed of mine tailings and magnetite ore enriched heavy medium and flowing the slurry into cyclonic separators of the so-called tapered or constant acceleration type. The density of the heavy medium is controlled in relation to the specific gravity of the coal product to be produced. For example, depending upon the ash content, i.e. quality, of the desired coal product, the specific gravity of the heavy medium is usually maintained within about 0.2 units of the specific gravity at which separation is desired.

The quality of a coal product is related to its ash content. For instance, low ash coal, i.e. coal having an ash content of less than about 10 percent by weight, requires that separation occur at a specific gravity of about 1.75. Usually, this requires that the specific gravity of the magnetite ore enriched heavy medium be at least about 1.56.

U.S. Pat. No. 4,364,822, issued to the present Applicant, discloses an autogenous heavy medium process for separating low ash coal from refuse. In the patented process, a heavy medium is established by recirculating fine coal and refuse to build up the specific gravity of the medium to about 1.3 and subjecting a feedstock slurry which includes the heavy medium to a cyclonic separating action of a particular nature. The patented process provides the advantage of eliminating the need for expensive magnetite ore, reducing fresh water requirements and minimizing pumping costs.

While there is a high demand for low ash coal, there are applications where high ash coal can be used satisfactorily. For instance, in certain modern fluidized bed combustion equipment, high ash coal can be burned efficiently. Accordingly, for these applications, there is a demand for high ash coal, i.e. coal having an ash content above about 20 percent, or a specific gravity of at least about 1.85.

If an attempt were made to produce high ash coal utilizing conventional magnetite ore enriched cyclonic separating processes, the separating medium would have to be maintained at a specific gravity of at least about 1.75. Such a high specific gravity can be achieved by increasing the quantity of magnetite ore used, but this would also increase magnetite losses which must be controlled to produce coal efficiently. Furthermore, at these higher specific gravities, the viscosity of the magnetite ore enriched medium, and feedstock slurry, increases, thereby substantially increasing the energy required simply to pump the slurry. Moreover, at such high specific gravities, the viscosity of the heavy medium also increases, and this exacerbates the problem of separating coal efficiently.

The process disclosed in Applicant's aforementioned patent is not suitable for producing high ash coal, primarily because there is not enough fine material in the raw feedstock to create a sufficiently high non-magnetite heavy media. Also, the viscosity of the media would be too high.

OBJECTS OF THE INVENTION

With the foregoing in mind, a primary object of the present invention is to provide a novel process for efficiently separating high ash coal from raw input.

Another object of the present invention is to provide a unique process for producing high ash coal from raw input by utilizing a magnetic heavy medium in combination with a particular type cyclone.

As yet another object, the present invention provides an improved process for producing high ash coal in a manner which overcomes the limitations of known processes.

Another object of the present invention is to produce a high ash coal product while maintaining a low specific gravity of the magnetic heavy medium being circulated through the cyclone.

SUMMARY OF THE INVENTION

More specifically, the present invention provides a process for producing high ash coal from raw input. In the process an aqueous slurry comprising magnetite ore and water is admixed to form a magnetite enriched heavy medium of a predetermined specific gravity. The raw inputs are mixed with the heavy medium to form a feedstock slurry which is subjected to a particular type of cyclonic separating action in which coal rich and refuse rich slurries are produced. The specific gravity of the heavy medium is maintained at least about 0.4 units below the specific gravity of the coal product produced. The coal rich and refuse rich slurries are dewatered and the magnetic medium is mixed therewith to form the magnetic heavy medium. Any remaining magnetite ore is separated from the coal and refuse product and is recycled in the process. This process allows for a high separating point, e.g. 1.95 specific gravity, while maintaining a much lower, e.g. 1.5 specific gravity magnetic circulating media. For anthracite coal of $\frac{3}{4}$ inch$\times$28 mesh average size having a high ash content, separation preferably occurs in a specific gravity range of about 1.9 to 2.0.

BRIEF DESCRIPTION OF THE DRAWING

The foregoing and other objects, features and advantages of the present invention should become apparent from the following description when taken in conjunction with the accompanying drawing which illustrates schematically apparatus particularly suited for use in practicing the process of the present invention.

DESCRIPTION OF THE PREFERRED PROCESS

The process of the present invention is carried out in apparatus illustrated schematically in the drawing. In the illustrated apparatus, the desired separation occurs in one or more cyclonic separators, such as the separator indicated by the numeral 11 connected to an upstream distributor box 12. A feedstock slurry is admitted tangentially into the separator 11, and after circulating therein in a manner to be described more fully hereinafter, separates into a coal rich overflow which exits the top of the separator 11 and a refuse rich underflow which exits the bottom thereof. After separation, the coal rich overflow, or float, after passing through appropriate processing stages, reports to a dewatering centrifuge and product pile via conveyor 13. The refuse rich underflow, after passing through a similar process, ultimately reports to a refuse pile via conveyor 14.

Raw input for separation in the process of the invention is supplied via conveyor 16. Water, such as clarified settling pond water, is supplied to the system via conduits 17.

The ash content of the coal product is above about 20 percent by weight, when analyzed in accordance with appropriate ASTM test procedures. Because of the relatively high amount of dense material contained in the coal product, the specific gravity of the product is also high, being on the order of about 1.8–2.0. As discussed heretofore, no processes are known whereby such a separation can be effected economically while, at the same time maintaining such a low specific gravity on the circulating media.

The process of the present invention permits anthracite coal to be separated from refuse economically by utilizing a heavy medium comprising a magnetite ore subjected to a particular type of cyclonic separating action. To this end, each cyclone 11 has a substantially cylindrical chamber providing a zone of constant acceleration for the feedstock slurry and a lower tapered portion providing a zone of increasing acceleration. A vortex finder depends into the cylindrical chamber a predetermined axial extent and may be, and preferably is, adjustable axially thereof. In the present process, the length of the cylindrical portion of the cyclone is slightly less than the diameter thereof.

For a more complete discussion of the structure and function of cyclones which are particularly suited for use in an autogenous heavy medium separating process, and for steps utilized to produce such medium, reference is made to U.S. Pat. No. 4,364,822 entitled "Autogenous Heavy Medium Process And Apparatus For Separating Coal From Refuse" issued to the present Applicant, the disclosure of which is incorporated by reference herein.

The relatively large size raw input supplied via conveyor 16 reports to a mixing vat 20 where the raw feedstock is mixed with magnetite ore supplied via pipe 21 from the underflow of the magnetic separator and the underflow of the drain and rinse screens. Recaptured magnetite ore is also supplied to the mixing vat 20 via pipe 23 connected to the upstream underflow of the fine float drain and rinse screen 24 via pipe 25 and to the fine refuse media drain and rinse screen 26 via pipe 27. Makeup water is also supplied to the vat 20 via pipe 28 connected to the clarified water conduit 17. The feedstock slurry is produced in the vat 20 by adding pulverized iron ore, magnetite, to the water in vat 20. Excess slurry is discharged from the mixing vats 30 and 40 to a pipe 45 which leads to a clarifying pond.

Both the fine refuse vat 30 and the fine float vat 40 are connected by pipes 47 and 48 to a magnetic separator 49 of conventional construction. The magnetic separator 49 functions in a well known manner to separate the magnetite ore from the liquid. Ore separated in the magnetic separator 49 is returned to the heavy media vat 20 via pipe 50. The clarified water is discharged to a waste water pond via a pipe 51.

The float product from the separating cyclones 11 is dewatered on a drain sieve 52 connected upstream of the fine float drain and rinse screen 24. The magnetite ore enriched underflow of the drain sieve 52 reports via pipe 53 and pipes 25 and 23 to the heavy media vat 20. The underflow from the cyclone 11 reports to a refuse media drain sieve 54 connected upstream of the media drain and rinse screen 26. The magnetite ore enriched underflow from the refuse media drain sieve 54 reports via pipe 55 and via pipes 27 and 23 to the heavy media vat 20. The overflow from the float media drain sieve 52 reports to the float drain and rinse screen 24, and the overflow from the refuse media drain sieve 54 reports to the refuse media drain and rinse screen 26.

In the steady-state operation of the process, the specific gravity of the heavy medium, is maintained at a predetermined specific gravity which is determined by the specific gravity of the coal to be produced. In other words, if it is desired to produce high ash coal, i.e. coal having an ash content greater than about 20 percent by weight, such coal product has a specific gravity of about 1.85 to about 2.0, and the specific gravity of the feedstock slurry is maintained at least about 0.4 units, and more preferably about 0.5 units, below that level. Adjustments can be effected either by increasing the amount of magnetite ore in the system or by diluting the medium with fresh water, or by a combination of these techniques as well known in the art. Preferably, the specific gravity measurements are made at a point immediately upstream of the magnetite ore supply unit 22, such as indicated at 60. Desirably, for a high ash coal product, such as 26 percent, of average $\frac{3}{8}$ inch$\times$28 mesh size, separation will occur in a specific gravity range of about 1.9 to about 2.0. The specific gravity of the separating medium will be maintained in a range of about 1.4 to about 1.5, or about 0.5 specific gravity units below the level at which separation is occurring.

For satisfactory results to be achieved, the cyclones should be of a special configuration, such as described heretofore. In such cyclones, the cyclonic separating action takes place in two stages as described above. The depth of the vortex finder is normally adjusted by the plant operator to obtain the desired ratio of float to sink, as well known in the art. The operator also adjusts the specific gravity (s.g.) of the circulating media.

The present invention provides several advantages. First of all, it provides for a high gravity separation point while maintaining a low specific gravity in the circulating media. This minimizes the amount of magnetite ore required which, in turn, minimizes the losses and hence cost associated with such losses. In addition, by minimizing the specific gravity of the circulating medium, pumping costs are minimized, and the viscosity of the recirculating medium is kept to a minimum thereby improving the overall operation of the process. As a result of the foregoing, the process of the present invention enables relatively high ash coal to be produced economically.

While a preferred process has been described in detail, various modifications, alterations and changes may be made without departing from the spirit and scope of the present invention as defined in the appended claims.

I claim:

1. A process for separating from raw input which includes coal and refuse a high ash coal having at least about 20 percent by weight of ash, comprising the steps of:

admixing magnetite ore with water to form a magnetite enriched heavy medium having a predetermined specific gravity;

mixing said raw input with said magnetite ore enriched medium to form a feedstock slurry;

cyclonically separating said feedstock slurry to produce a coal rich slurry containing said at least 20 percent by weight ash coal product and a refuse rich slurry;

said cyclonic separating step including the steps of:

admitting said feedstock slurry tangentially into a substantially cylindrical chamber for subjecting said feedstock slurry to substantially constant acceleration through a first axial extent, immediately thereafter admitting said feedstock slurry into a tapered chamber in fluid communication with said cylindrical chamber to subject said feedstock slurry to increasing acceleration through a second axial extent, exhausting said coal rich slurry having said at least about 20 percent by weight ash content upwardly in one direction from said cylindrical chamber through a vortex finder extending down into said cylindrical chamber, and discharging said refuse rich slurry downwardly in the opposite direction through an orifice in said tapered chamber aligned axially with said vortex finder;

dewatering the coal rich slurry to produce a coal product having a specific gravity of at least about 1.85;

maintaining said specific gravity of said magnetite enriched heavy medium at least about 0.4 units below said specific gravity of said coal product;

dewatering said refuse rich slurry to produce a refuse product; and separating any remaining magnetite ore from the coal and refuse products;

whereby high ash coal can be separated in a continuous process.

2. A process for separating coal having an ash content of at least about 20 percent by weight from raw input which includes coal and refuse, comprising the steps of:

forming a magnetic medium having a predetermined specific gravity;

mixing said raw input with said magnetic medium to form a feedstock slurry;

cyclonically separating said feedstock slurry to produce a coal rich slurry containing a coal product having said at least about 20 percent by weight ash content and a refuse rich slurry;

said cyclonic separating step including the steps of:

admitting said feedstock slurry tangentially into a substantially cylindrical chamber for subjecting said feedstock slurry to substantially constant acceleration through a first axial extent, immediately thereafter admitting said feedstock slurry into a tapered chamber in fluid communication with said cylindrical chamber to subject said feedstock slurry to increasing acceleration through a second axial extent corresponding to about one-half said first axial extent, exhausting said coal rich slurry having said at least 20 percent by weight ash coal upwardly in one direction from said cylindrical chamber through a vortex finder extending down into said cylindrical chamber a distance less than about one-half said first axial extent, and discharging said refuse rich slurry downwardly in the opposite direction through an orifice in said tapered chamber aligned axially with said vortex finder;

dewatering the coal rich slurry to produce a coal product having a specific gravity of at least about 1.9;

maintaining said specific gravity of said magnetic heavy medium at less than about 1.5;

dewatering said refuse rich slurry to produce a refuse product and a fine refuse slurry;

separating any remaining magnetite ore from the coal and refuse products;

whereby high ash coal can be separated in a continuous process.

3. A process for separating high ash coal having an ash content of at least about 20 percent be weight from raw input which includes coal and refuse, comprising the steps of:

admixing magnetite ore and water to form a magnetite enriched heavy medium having a predetermined specific gravity;

mixing said raw input with said magnetite ore enriched medium to form a feedstock slurry, cyclonically separating said feedstock slurry to produce a coal rich slurry and a refuse rich slurry;

said cyclonic separating step including the steps of:

admitting said feedstock slurry tangentially into a substantially cylindrical chamber for subjecting said feedstock to substantially constant acceleration through a first axial extent, immediately thereafter admitting said feedstock slurry into a tapered chamber in fluid communication with said cylindrical chamber to subject said feedstock slurry to increasing acceleration through a second axial extent corresponding to about one-half said first axial extent, exhausting said coal rich slurry having said at least 20 percent by weight ash coal upwardly in one direction from said cylindrical chamber through a vortex finder extending down into said cylindrical chamber a predetermined distance, and discharging said refuse rich slurry downwardly in the opposite direction through an orifice in said tapered chamber aligned axially with said vortex finder;

dewatering the coal rich slurry to produce a coal product having a specific gravity in a range of about 1.9 to about 2.0;

maintaining said specific gravity of said magnetite enriched heavy medium in a range of about 1.4 to about 1.5;

dewatering said refuse rich slurry to produce a refuse product;

mixing said coal and refuse slurries together to form a component of said magnetic medium; and separating any remaining magnetite ore from the coal and refuse products;

whereby high ash coal can be separated in a continuous process.

* * * * *